US008606125B2

(12) United States Patent
Jung et al.

(10) Patent No.: US 8,606,125 B2
(45) Date of Patent: Dec. 10, 2013

(54) IMAGE FORMING APPARATUS FOR CHECKING CONNECTION AND DISCONNECTION STATUS OF DEVELOPING UNIT WITH IMAGE FORMING APPARATUS AND METHOD THEREOF

(75) Inventors: Soo-Young Jung, Suwon-si (KR); Sang-sin Park, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/346,224

(22) Filed: Jan. 9, 2012

(65) Prior Publication Data

US 2013/0011146 A1 Jan. 10, 2013

Related U.S. Application Data

(63) Continuation of application No. 12/485,982, filed on Jun. 17, 2009, now Pat. No. 8,116,639.

(30) Foreign Application Priority Data

Oct. 1, 2008 (KR) ..... 10-2008-0096557

(51) Int. Cl.
*G03G 15/00* (2006.01)

(52) U.S. Cl.
USPC ..... 399/13

(58) Field of Classification Search
USPC ..... 399/13, 90; 324/500, 522
See application file for complete search history.

(56) References Cited

U.S. PATENT DOCUMENTS

| | | | | |
|---|---|---|---|---|
| 6,263,170 | B1 | 7/2001 | Bortnem | |
| 2002/0164169 | A1 * | 11/2002 | Arai et al. | 399/12 |
| 2004/0013447 | A1 * | 1/2004 | Kim | 399/112 |
| 2007/0162671 | A1 | 7/2007 | Seo | |

OTHER PUBLICATIONS

Notice of Allowance mailed Oct. 7, 2011 in U.S. Appl. No. 12/485,982.
U.S. Appl. No. 12/485,982, filed Jun. 17, 2009, Soo-young Jung et al., Samsung Electronics Co., Ltd.

* cited by examiner

*Primary Examiner* — Billy J Lactaoen
(74) *Attorney, Agent, or Firm* — Staas & Halsey LLP

(57) ABSTRACT

An image forming apparatus is provided which includes a multiplexer (MUX) which is able to be connected to at least one developer supplier, at least one pull-up resistor which is connected in parallel to at least one connection line between the at least one developer supplier and the MUX, and a central processing unit (CPU) which detects a connection signal from the at least one pullup resistor and the at least one connection line, and determines whether an initial developer supplier is mounted according to the value of the connection signal.

6 Claims, 6 Drawing Sheets

IMAGE FORMING APPARATUS FOR CHECKING CONNECTION AND DISCONNECTION STATUS OF DEVELOPING UNIT WITH IMAGE FORMING APPARATUS AND METHOD THEREOF

CROSS-REFERENCE TO RELATED APPLICATIONS

This application is a continuation application filed under 35 U.S.C. §111(a) of U.S. patent application Ser. No. 12/485,982 filed Jun. 17, 2009 now U.S. Pat. No. 8,116,639, which claims the benefit under 35 U.S.C. §119(a) of Korean Patent Application No. 10-2008-0096557, filed on Oct. 1, 2008, in the Korean Intellectual Property Office, the entire disclosures of which are hereby incorporated by reference.

BACKGROUND

1. Field

The present disclosure relates to an image forming apparatus and a method for checking the status thereof. More particularly, the present disclosure is directed to an image forming apparatus capable of determining whether a developer supplier is mounted, and a method for checking the status thereof.

2. Description of the Related Art

The recent development of electronic technology has spurred the development of computers and peripheral devices having greater performance, particularly image forming apparatuses.

Image forming apparatuses refer to apparatuses capable of forming textual or graphical images on sheets of paper or on other recording media. Non-limiting examples of an image forming apparatus may include, for example, printers, scanners, facsimile machines, copiers or multifunctional peripherals (MFP) capable of functioning as two or more of the above-described devices.

Image forming apparatuses are typically able to perform printing employing one of several types of printing method, such as a dot matrix type, an inkjet type or an electrophotographic type. Recently, electrophotographic image forming apparatuses have become widespread.

Electrophotographic image forming apparatuses use a developer such as a toner for forming images. The developer is a consumable product, so if an image forming apparatus is used for a predetermined period of time, the developer may become exhausted. When the developer is exhausted, a user may replace the spent developer supplier (or cartridge) with a new one. Until the developer is exhausted, the developer supplier originally provided with the image forming apparatus by the manufacture may be used. The initial developer supplier however may not include a customer replaceable unit monitor (CRUM), but a subsequent user replaced developer supplier may include a CRUM.

A developing device used for an electrophotographic image forming apparatus may include a developing unit and a developer supplier, e.g., a bottle or other types of container, for supplying a developer to the developing unit. The developing unit and the developer supplier may be separable from each other. In this situation, so long as a quantity of developer remains inside the developing unit even when the bottle is removed from the developing unit, image forming operations may continue to be performed for a predetermined number of printing media. Accordingly, it is impossible for a user to know whether the developer supplier is mounted or whether it is properly mounted until the developer remaining in the developing unit is exhausted.

Additionally, if the initial or the original developer supplier is subsequently replaced with a non-genuine replacement developer supplier, the image forming apparatus may malfunction. Accordingly, efficient checking of the status of developer supplier(s) of an image forming apparatus is desirable.

SUMMARY

Additional aspects and/or advantages will be set forth in part in the description which follows and, in part, will be apparent from the description, or may be learned by practice of the invention.

According to an aspect of the present invention, there is provided an image forming apparatus that may include a multiplexer (MUX) connectable to at least one developer supplier; at least one pull-up resistor connected in parallel to at least one connection line between the at least one developer supplier and the MUX; and a central processing unit (CPU) configured to detect a connection signal from the at least one pull-up resistor and the at least one connection line when the MUX is currently deactivated. The CPU may be further configured to determine whether an initial developer supplier is mounted according to a value of the connection signal.

If a connection signal having a low value is detected, the CPU may determine that an initial developer supplier corresponding to at least one connection line is mounted in the image forming apparatus.

If a connection signal having a high value is detected, the CPU may activate the MUX and check whether the at least one developer supplier connected to the MUX has a customer replaceable unit monitor (CRUM). If the CRUM is found as a result of checking, the CPU may determine that a replaceable developer supplier corresponding to the at least one connection line is mounted, and if the CRUM is not found, the CPU may determine that the image forming apparatus is in abnormal state.

The image forming apparatus may further include a display unit which displays a message stating the abnormal state of the image forming apparatus.

The initial developer supplier may include a connection port connected to the at least one connection line, a ground port, and a resistor connected in series between the connection port and the ground port.

The at least one connection line may be a serial clock line (SCL).

According to another aspect of the present invention, there is provided a developer supplier including a serial clock line (SCL) port connectable to a control board of an image forming apparatus via an SCL line; a ground port; and a resistor connected in series between the SCL port and the ground port.

According to another aspect, there is provided a method for checking a statue of an image forming apparatus, the method including deactivating a multiplexer (MUX) connectable to at least one developer supplier through at least one connection line; detecting a connection signal from the at least one connection line; and determining whether an initial developer supplier is mounted according to a value of the connection signal.

The determining may include, if the connection signal having a low value is detected, determining that an initial developer supplier corresponding to the least one connection line is mounted.

The method may further include, if the connection signal having a high value is detected, activating the MUX, checking whether the at least one developer supplier connected to the MUX has a customer replaceable unit monitor (CRUM); and determining that a replaceable developer supplier corresponding to the least one connection line is mounted if the CRUM is found as a result of checking, and determining that the image forming apparatus is in abnormal state if the CRUM is not found.

The initial developer supplier may include a connection port connected to the at least one connection line, a ground port, and a resistor connected in series between the connection port and the ground port.

The at least one connection line may be a serial clock line (SCL). The at least one connection line may be connected in parallel to a pull-up resistor having a predetermined resistance.

According to yet another aspect, an image forming apparatus may include a developer supplier connection port configured to establish therethrough an electrical connection between the image forming apparatus and a developer supplier; a pull-up resistor connected between the developer supplier connection port and an electrical potential source; a switchable device configured to selectively connect the developer supplier connection port to the image forming apparatus based on a control signal; and a central processing unit (CPU) configured to output the control signal to the switchable device so as to cause the switchable device to be in at least a disconnected state, the switchable device disconnecting the developer supplier connection port from the image forming apparatus in the disconnected state, the CPU having an input connected to the developer supplier connection port, the CPU being further configured to receive a connection detection signal through the input when the switchable device is in the disconnected state, the connection detection signal corresponding to an electrical potential level at the developer supplier connection port.

The CPU is further configured to control one or more components of the image forming apparatus to perform an image forming operation if the connection detection signal has a first electrical potential level. The CPU may be further configured to cause a message indicating an abnormal state of the image forming apparatus to be displayed if the detection signal has a second electrical potential level.

Alternatively, the CPU may be configured to control one or more components of the image forming apparatus to perform an image forming operation if the connection detection signal has a first electrical potential level. If the connection detection signal has a second electrical potential level, the CPU is configured to output the control signal to the switchable device to cause the switchable device to be in a connected state, in which the switchable device connects the developer supplier connection port and the image forming apparatus, and to send a query signal to the developer supplier connection port through the switchable device.

The CPU may be further configured to control the one or more components of the image forming apparatus to perform the image forming operation if a response to the query signal is received from the developer supplier connection port through the switchable device. The CPU may be configured to cause a message indicating an abnormal state of the image forming apparatus to be displayed if the response is not received.

The developer supplier connection port comprises a serial clock line (SCL) port.

The electrical potential source comprises a voltage source supplying a voltage greater than 0.

The first electrical potential level may be lower than the second electrical potential level.

BRIEF DESCRIPTION OF THE DRAWINGS

Various aspects of the present disclosure will be more apparent from embodiments of the present disclosure with reference to the accompanying drawings, in which.

DETAILED DESCRIPTION

Several embodiments of the present invention will now be described in greater detail with reference to the accompanying drawings.

The matters defined in the description such as a detailed construction and elements are provided to assist in a comprehensive understanding of the embodiments of the invention, and are merely illustrative. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
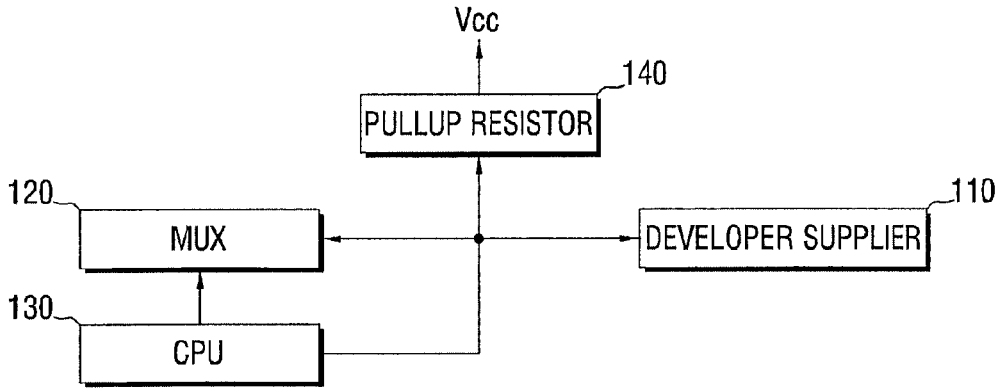
FIG. 1 is a block diagram of an image forming apparatus according to an embodiment of the present invention.

FIG. 1 is a block diagram of an image forming apparatus according to an embodiment of the present invention. The image forming apparatus of FIG. 1 includes a developer supplier 110, a multiplexer (MUX) 120, a central processing unit (CPU) 130 and a pullup resistor 140. The image forming apparatus of FIG. 1 may be implemented as a printer, a copier, a facsimile machine or a multifunctional peripheral (MFP).

The developer supplier 110 provides a developing device (not shown) with a developer such as, e.g., toner, used in forming an image. The developing device causes the developer provided by the developer supplier 110 to be attached to a latent image formed on the surface of a photoconductor (not shown). The developer attached to the latent image is transferred onto a sheet of paper by a transferring device (not shown), so that an image is formed. Such a method and structure for forming an image are commonly used by conventional electrophotographic image forming apparatuses, so no further description and illustration thereof are required.

Although FIG. 1 shows a single developer supplier 110, a plurality of developer suppliers may be provided each for one or more of multiple colors, for example cyan (C), magenta (M), yellow (Y) and black (K) developer suppliers.

The MUX 120 connects the CPU 130 to the developer supplier 110. The MUX 120 multiplexes data and clock signals output from the CPU 130, and transmits the multiplexed data and signals to the developer supplier 110. Accordingly, the developer supplier 110 may supply a quantity of developer at an appropriate time.

The CPU 130 is connected to the developer supplier 110 through the MUX 120. For example, the CPU 130 may be connected to the developer supplier 110 via an Inter-Integrated Circuit (I2C) interface. The I2C interface is able to control a large number of chips using data lines (namely, serial data lines (SDL)), and clock lines (namely, serial clock lines (SCL)).

Additionally, the CPU 130 detects a connection signal from a connection line between the MUX 120 and the developer supplier 110, and determines whether the developer supplier 110 is mounted according to the detected connection signal.

The initial developer supplier 110 provided by a manufacturer of the image forming apparatus at the time of fabrication of the image forming apparatus may include at least one connection port through which the developer supplier 110 is able to be connected to the MUX 120, and a ground port. In this situation, the at least one connection port and the ground port may be connected directly without any additional component, or may be connected by a resistance, e.g., on the order of hundreds of ohms (Ω).

If the developer supplier 110 is mounted normally in the image forming apparatus a voltage may be distributed by the pullup resistor 140 coupled between a bias voltage Vcc and a connection node, and by the resistance of the developer supplier 110. Accordingly, the CPU 130 may detect a connection signal having a low value.

Alternatively, if the developer supplier 110 is not mounted in the image forming apparatus, or if a regular developer supplier, namely a replaceable developer supplier, is connected, one end of the connection line may be opened, so that an electric current flowing through the bias voltage Vcc may flow directly to the CPU 130 through the pullup resistor 140. Accordingly, the CPU 130 may detect a connection signal having a high value.

Therefore, if a connection signal having a low value is detected, the CPU 130 may determine that the initial developer supplier 110 is mounted normally in the image forming apparatus, and if a connection signal having a high value is detected, the CPU 130 may determine that the initial developer supplier 110 is not mounted in the image forming apparatus.

If it is determined that the initial developer supplier 110 is properly mounted in the image forming apparatus, and if a user enters a print job command later, the CPU 130 may control various units inside the image forming apparatus to perform the image forming job normally. If it is determined that the initial developer supplier 110 is not properly mounted, the CPU 130 may display a message stating that the image forming apparatus is in abnormal state.

Additionally, if a replaceable developer supplier installed by a user, is mounted in the image forming apparatus rather than the initial developer supplier, a connection signal having a high value may be detected. Accordingly, the CPU 130 may check again whether a replaceable developer supplier is connected.

In more detail, since the replaceable developer supplier includes a customer replaceable unit monitor (CRUM), if an acknowledge signal is received from the replaceable developer supplier via the connection line in response to a query, the CPU 130 may determine that the replaceable developer supplier is properly connected. Therefore, if a user enters a job command later, the image forming job may be executed normally.

The above-described process of determining whether the developer supplier 110 is mounted in the image forming apparatus may be performed when the image forming apparatus is turned on or when a cover of a main body of the image forming apparatus is open or closed.

Figure 2:
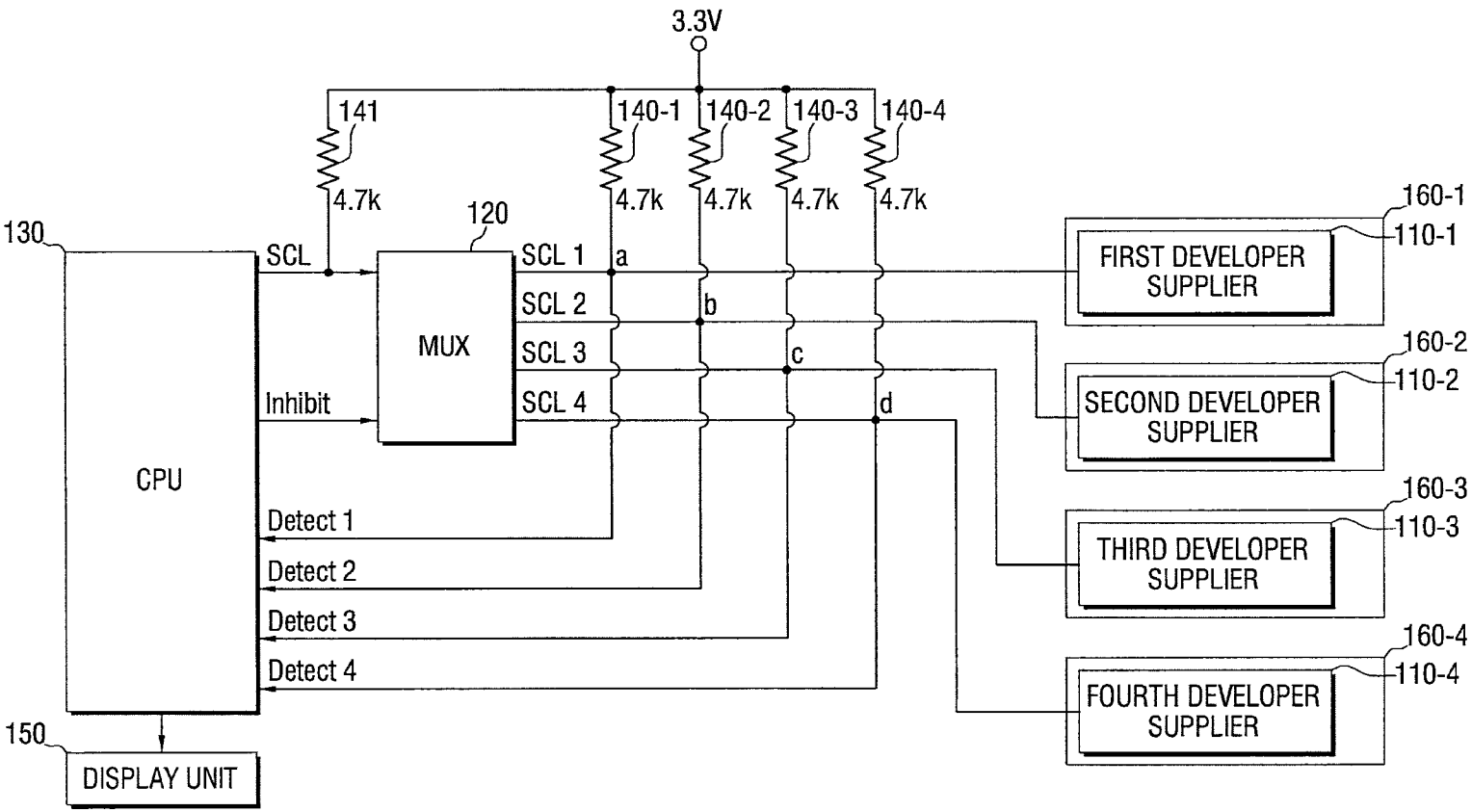
FIG. 2 is a detailed block diagram of the image forming apparatus shown in FIG. 1.

FIG. 2 is a detailed block diagram of the image forming apparatus shown in FIG. 1.

The image forming apparatus of FIG. 2 includes four developing devices 160-1 to 160-4, a MUX 120, five pullup resistors 140-1 to 140-4 and 141, a CPU 130, and a display unit 150.

The four developing devices 160-1 to 160-4 may be provided separately. The four developing devices 160-1 to 160-4 may include four respective developing units (not shown) and four respective developer suppliers 110-1 to 110-4 for supplying developers to the four developing units. Herein, each of the four developer suppliers 110-1 to 110-4 may be a container, e.g., a bottle, containing a supply of developer.

Additionally, the CPU 130 may be connected to each of the four developing devices 160-1 to 160-4 via an 12C interface, for example.

The CPU 130 and the MUX 120 may be integrated on a single control board.

The four developing devices 160-1 to 160-4 may be connected to the MUX 120 via connection lines SCL1 to SCL4, respectively. The CPU 130 is also connected to the connection lines SCL1 to SCL4 to detect connection signals Detect 1 to Detect 4 from the connection lines SCL1 to SCL4. The pullup resistors 140-1 to 140-4 are connected to connection nodes a, b, c, d on the connection lines SCL1 to SCL4 at which the connection signals Detect 1 to Detect 4 are detected, respectively.

The pullup resistors 140-1 to 140-4 connect a bias voltage, e.g., 3.3 V, to each of the connection nodes a, b, c, d. While a pullup resistance of about 4.7 kΩ. is used in the embodiment shown in FIG. 2, the magnitude of the pullup resistance may vary, and may be determined according to the magnitude of voltage required to operate a particular developing device and the magnitude of the bias voltage thereof.

The CPU 130 is connected to the MUX 120 via an SCL line and an inhibit line. The SCL line may also be connected to the pullup resistor 141 in order to pull up the bias voltage.

The inhibit line functions to transfer a control signal to activate or deactivate the MUX 120. If a determination is required as to whether the developer suppliers 110-1 to 110-4 (for example, when the image forming apparatus is turned on or when a cover of a main body of the image forming apparatus is open or closed), the CPU 130 controls the MUX 120 to be deactivated in order to prevent a signal output from the SCL line thereof from colliding with the connection signals Detect 1 to Detect 4 received via the connection nodes a, b, c, d.

In this situation, the CPU 130 determines whether the developer suppliers 110-1 to 110-4 connected respectively to the connection lines SCL1 to SCL4 are mounted, according to the connection signals Detect 1 to Detect 4 as described above with reference to FIG. 1.

If connection signals having a low value are detected from all the connection lines, the CPU 130 may determine that the image forming apparatus is in normal mode, and wait for a user job command.

Alternatively, if a connection signal having a high value is detected from even only a single connection line, the CPU 130 may determine whether a replaceable developer supplier is mounted in a developing device connected to the corresponding connection line.

For example, if the connection signal Detect 1 detected at the connection node a has a high value, the CPU 130 may transmit a query via the first connection line SCL1. If an acknowledge is received in response to the query via the first connection line SCL1, the CPU 130 may determine that the replaceable developer supplier is mounted in the first developing device 160-1.

Alternatively, if the acknowledge is not received for a predetermined period of time, the CPU 130 may determine that no developer supplier is mounted in the first developing device 160-1, and control the display unit 150 to notify that the image forming apparatus is in abnormal state.

As described above, the image forming apparatus according to the embodiments may determine whether a developer supplier is mounted therein using a simple circuit configuration. If the developer supplier is not mounted in the image forming apparatus, the image forming job may be performed using only the developer remaining in the developing unit to avoid possible problems associated with the image forming apparatus operating with insufficient or no toner supply. For example, when the image forming apparatus is allowed to operate without or insufficient developer, frictional loads may increase inside the developing unit, increasing torques, and as a result noise and frictional heat may be generated. Additionally, a film phenomenon may occur on a contact area between a surface of a developing roller and a doctor blade, and thus it may be difficult to form a toner layer on the surface of the developing roller, and the toner may become fused by the frictional heat generated in the contact area against the doctor blade. Furthermore, the lubricative effect of the toner may be reduced, which may cause the frictional loads between a photoconductor and a cleaning blade to increase, and thus the blade may be turned over. However, the image forming apparatus according to embodiments described herein may prevent or mitigate at least some of these problems in advance.

While as illustrative examples the connection signals Detect 1 to Detect 4 are detected on the connection lines SCL1 to SCL4, as shown in FIGS. 1 and 2, the locations where the connection signals could detected are not so limited. Alternative embodiments employing any lines or connections that are able to connect a developer supplier to a CPU are also possible. In this situation, pullup resistors and detection lines may be connected to such other lines or connections.

Figure 3:
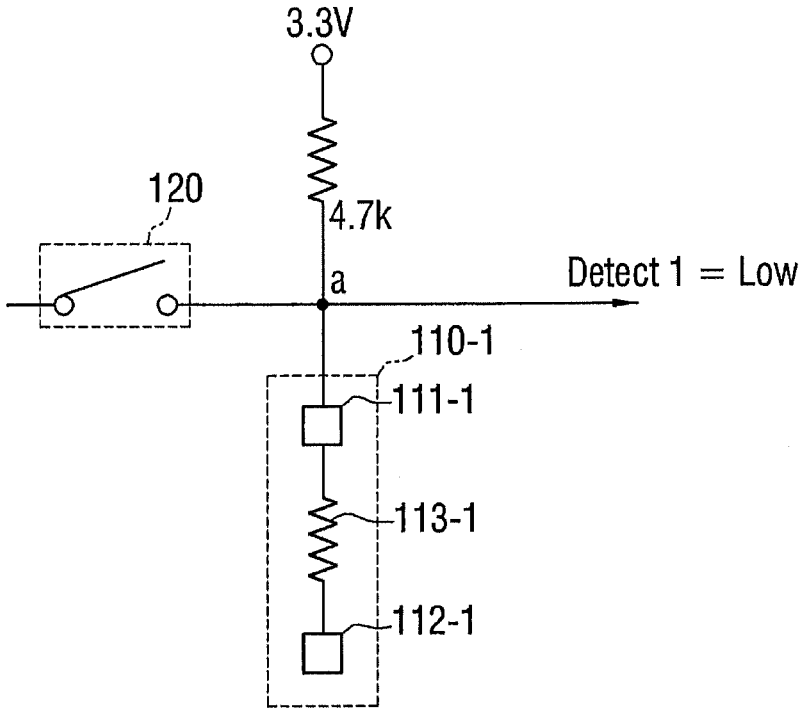
FIGS. 3 and 4 illustrate a process of determining whether an initial developer supplier is mounted.
Figure 4:
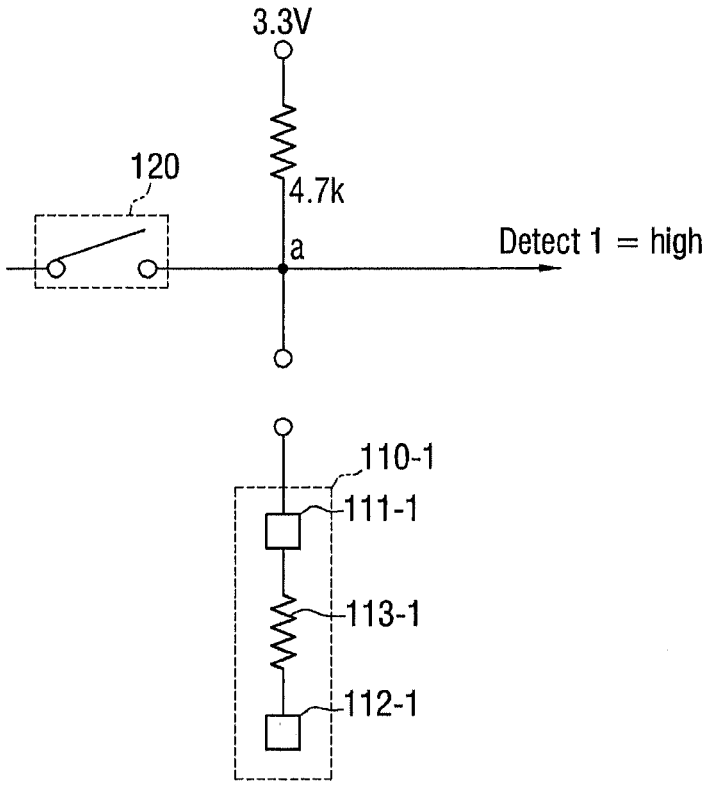

FIGS. 3 and 4 are views provided to explain the internal configuration of a developer supplier and a process of determining whether the developer supplier is mounted in an image forming apparatus. For convenience of description. FIGS. 3 and 4 show only the first developer supplier 110-1 connected via a first connection line SCL1.

In FIG. 3, the first developer supplier 110-1 includes a connection port 111-1, a ground port 112-1, and a resistor 113-1 for connecting the connection port 111-1 and the ground port 112-1. The connection port 111-1 is connected to the MUX 120 via the first connection line SCL1, and the ground port 112-1 is connected to a ground electrode.

The MUX 120 is deactivated by a deactivation signal and may thus be opened, as shown in FIG. 3. In this situation, the voltage is distributed at the connection node a by the resistance of the first developer supplier 110-1 and by a pullup resistance of, e.g., about 4.7 kΩ, resulting in a potential difference from the bias voltage 3.3 V. Accordingly, a first connection signal Detect 1 may have a low value.

On the other hand, if the first developer supplier 110-1 is not mounted in the image forming apparatus normally, as shown in FIG. 4, the connection node a is disconnected from the first developer supplier 110-1. Accordingly, no electric current from the bias voltage flows into the first developer supplier 110-1, and thus the first connection signal Detect 1 may have a high value.

In this situation, if there is no resistor 113-1 connecting the connection port 111-1 and the ground port 112-1 even when the first developer supplier 110-1 is mounted normally, that is, if a replaceable developer supplier or a non-genuine developer supplier is mounted, no electric current of the bias voltage may flow into the first developer supplier 110-1 in the same manner as shown in FIG. 4. Therefore, a first connection signal Detect 1 having a high value may be detected.

In such cases, the CPU 130 may check whether the CRUM is included, as described above, may again check whether the replaceable developer supplier is connected, and may determine that the image forming apparatus is in abnormal state if the replaceable developer supplier is not mounted.

Figure 5:
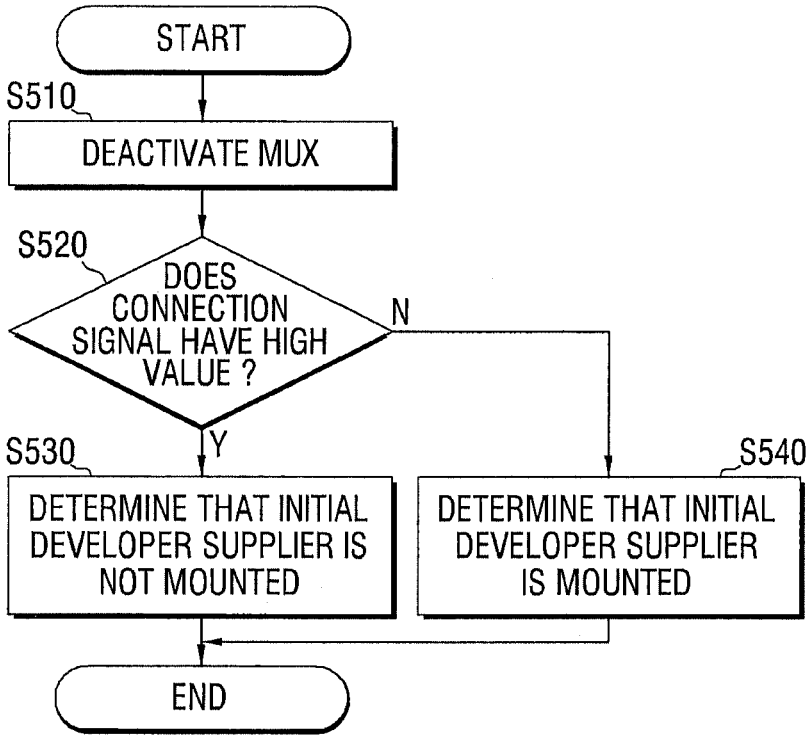
FIG. 5 is a flowchart illustrating a method for checking the status of an image forming apparatus according to an embodiment of the present invention.

FIG. 5 is a flowchart explaining a method for checking the status of an image forming apparatus according to an embodiment of the present invention.

In FIG. 5, if the image forming apparatus is turned on, or if a cover of the image forming apparatus is opened or closed, the MUX is deactivated (S510), and the image forming apparatus determines whether a connection signal detected from a connection line has a high value (S520).

If it is determined that the connection signal has a high value (S520-Y), it is determined that an initial developer supplier is not mounted in the image forming apparatus (S530), but if it is determined that the connection signal has a low value (S520-N), it is determined that the initial developer supplier is mounted in the image forming apparatus (S540).

If the initial developer supplier is mounted in the image forming apparatus, the image forming apparatus may perform image forming jobs in response to the user command. On the other hand, if the initial developer supplier is not mounted in the image forming apparatus, the image forming apparatus may display a message indicating this status, or may perform subsequent operations such as checking whether the replaceable developer supplier is mounted.

Figure 6:
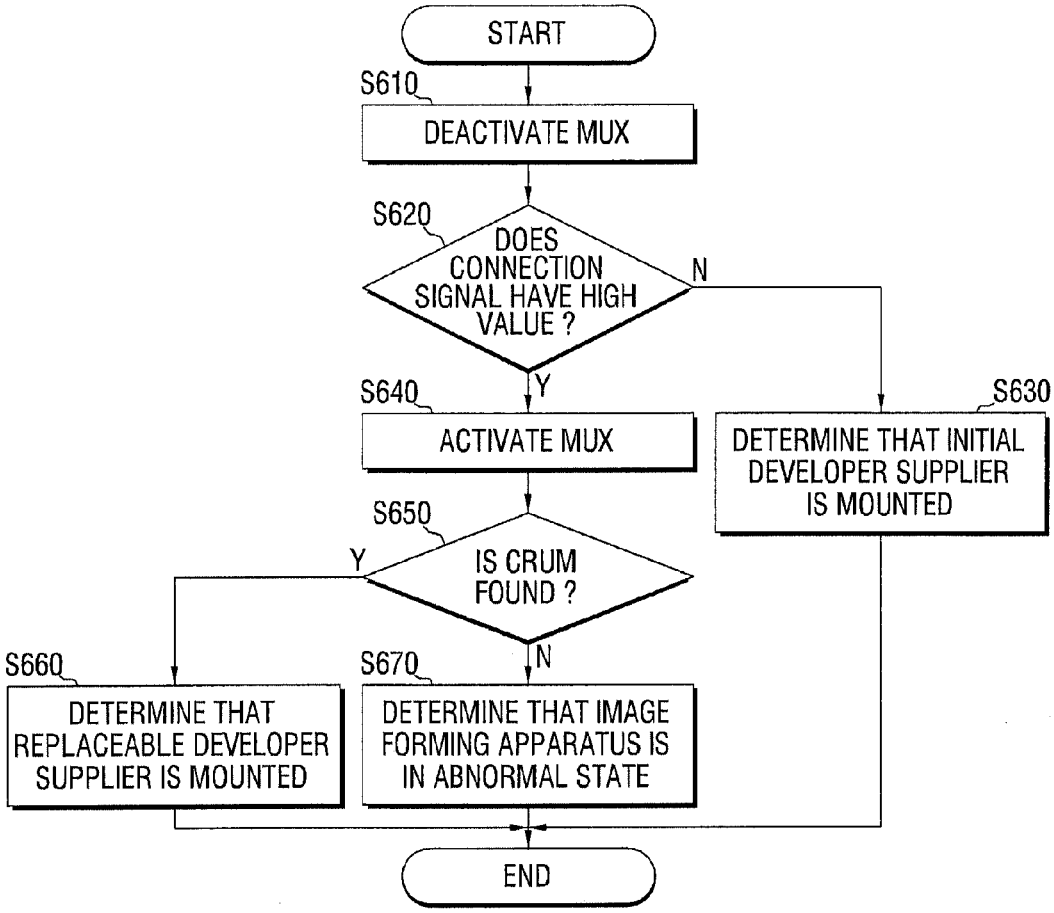
FIG. 6 is a flowchart illustrating a method for checking the status of an image forming apparatus according to another embodiment of the present invention.

FIG. 6 is a flowchart explaining a method for checking the status of an image forming apparatus according to another embodiment of the present invention. In FIG. 6, the MUX is deactivated (S610), and the image forming apparatus determines whether a connection signal detected from a connection line has a high value (S620). If it is determined that the connection signal has a low value (S620-N), it is determined that the initial developer supplier is mounted in the image forming apparatus (S630).

If it is determined that the connection signal has a high value (S620-Y), the MUX is activated (S640), and the image forming apparatus then searches for a CRUM mounted in the developer supplier via the connection line (S650).

As a result, if the CRUM is found, a replaceable developer supplier is determined to be mounted (S660), but if not, the image forming apparatus is determined to be in abnormal state (S670).

In operation S670, a message informing that the image forming apparatus is in the abnormal state is displayed.

Additionally, if it is determined that the initial developer supplier or the replaceable developer supplier is mounted, the image forming apparatus may wait for a user command and then perform an operation corresponding to the user command.

As described above, according to embodiments of the present invention, it is possible to easily check whether an initial developer supplier having no CRUM is mounted in an image forming apparatus without any additional detecting sensor. Hence, it is also possible to prevent in advance problems that may occur when the image forming apparatus is allowed to operate without any developer supplier.

The foregoing embodiments and advantages are merely illustrative examples and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A developer supplier, comprising:

a serial clock line (SCL) port configured to connect to a multiplexer of a control board of an image forming apparatus via an SCL;

a ground port; and a resistor connected in series between the SCL port and the ground port, wherein the control board comprises:

the multiplexer (MUX) configured to connect to at least one developer supplier;

at least one pullup resistor connected in parallel to at least one connection line between the at least one developer supplier and the MUX; and a central processing unit (CPU) configured to detect a connection signal from the at least one pullup resistor and the at least one connection line when the MUX is currently deactivated, the CPU being further configured to determine whether an initial developer supplier is mounted according to a value of the connection signal.

2. The developer supplier of claim 1, wherein, if the detected connection signal has a low value, the CPU determines that an initial developer supplier corresponding to the at least one connection line is mounted.

3. The developer supplier of claim 1, wherein, if the detected connection signal has a low value, the CPU activates the MUX and checks whether the at least one developer supplier connected to the MUX has a customer replaceable unit monitor (CRUM), and if the CRUM is found as a result of checking, the CPU determines that a replaceable developer supplier corresponding to the at least one connection line is mounted, and if the CRUM is not found, the CPU determines that the image forming apparatus is in an abnormal state.

4. The developer supplier of claim 3, further comprising:

a display unit configured to display a message indicating the abnormal state of the image forming apparatus.

5. The developer supplier of claim 1, wherein the initial developer supplier comprises a connection port connected to the at least one connection line, a ground port, and a resistor connected in series between the connection port and the ground port.

6. The developer supplier of claim 1, wherein the at least one connection line is a serial clock line (SCL).

* * * * *